US006193483B1

(12) United States Patent
Michael

(10) Patent No.: US 6,193,483 B1
(45) Date of Patent: Feb. 27, 2001

(54) FULL FLOW TUBING STATIONARY VALVE PUMP APPARATUS

(76) Inventor: Clarence Michael, 315 N. Thompson, Pratt, KS (US) 67124

( * ) Notice: Subject to any disclaimer, the term of this patent is extended or adjusted under 35 U.S.C. 154(b) by 0 days.

(21) Appl. No.: 09/253,389

(22) Filed: Feb. 19, 1999

Related U.S. Application Data

(60) Provisional application No. 60/075,159, filed on Feb. 19, 1998.

(51) Int. Cl.[7] ..... F04B 39/10
(52) U.S. Cl. ..... 417/567
(58) Field of Search ..... 417/567, 559, 417/555.2, 547

(56) References Cited

U.S. PATENT DOCUMENTS

| | | | | |
|---|---|---|---|---|
| 663,029 | | 12/1900 | Horsley . | |
| 1,167,886 | | 1/1916 | Chapman . | |
| 1,513,146 | | 10/1924 | Wilson . | |
| 1,572,618 | | 2/1926 | Nolan . | |
| 1,676,186 | * | 7/1928 | Hawkins | 417/567 |
| 1,730,297 | | 10/1929 | Ruthven . | |
| 2,131,822 | * | 10/1938 | Schmidt | 417/567 |
| 3,941,510 | | 3/1976 | Morgan | 417/57 |
| 4,009,756 | | 3/1977 | Zehren | 166/250 |
| 5,062,480 | | 11/1991 | Chacin U. et al. | 166/108 |
| 5,127,803 | | 7/1992 | Walter | 417/57 |
| 5,131,466 | | 7/1992 | Chacin U. et al. | 166/105 |

* cited by examiner

*Primary Examiner*—Timothy S. Thorpe
*Assistant Examiner*—Trelita Perry
(74) *Attorney, Agent, or Firm*—Flanagan & Flanagan; John R. Flanagan; John K. Flanagan

(57) ABSTRACT

A full flow tubing stationary valve pump apparatus includes an cuter annulus barrel, an inner working barrel positioned in radially inwardly spaced relation from the outer annular barrel to define a vertical flow annulus therebetween, an elongated inner plunger disposed within and vertically movable by upstrokes and downstrokes relative to the inner working barrel, a lower intake valve assembly disposed within and supported by the outer annulus barrel below the inner plunger, and an upper discharge valve assembly disposed within and supported by the outer annular barrel below the inner plunger and above the lower intake valve assembly. The outer annular barrel defines a working chamber between the lower intake valve assembly and upper discharge valve assembly into which crude oil can be drawn through the lower intake valve assembly from a production formation therebelow upon the upstroke of the inner plunger which causes the lower intake valve assembly to open and the upper discharge valve assembly to close and from which crude oil can be forced through the upper discharge valve assembly into the vertical flow annulus thereabove upon the downstroke of the inner plunger which causes the upper discharge valve assembly to open and the lower intake valve assembly to close.

28 Claims, 4 Drawing Sheets

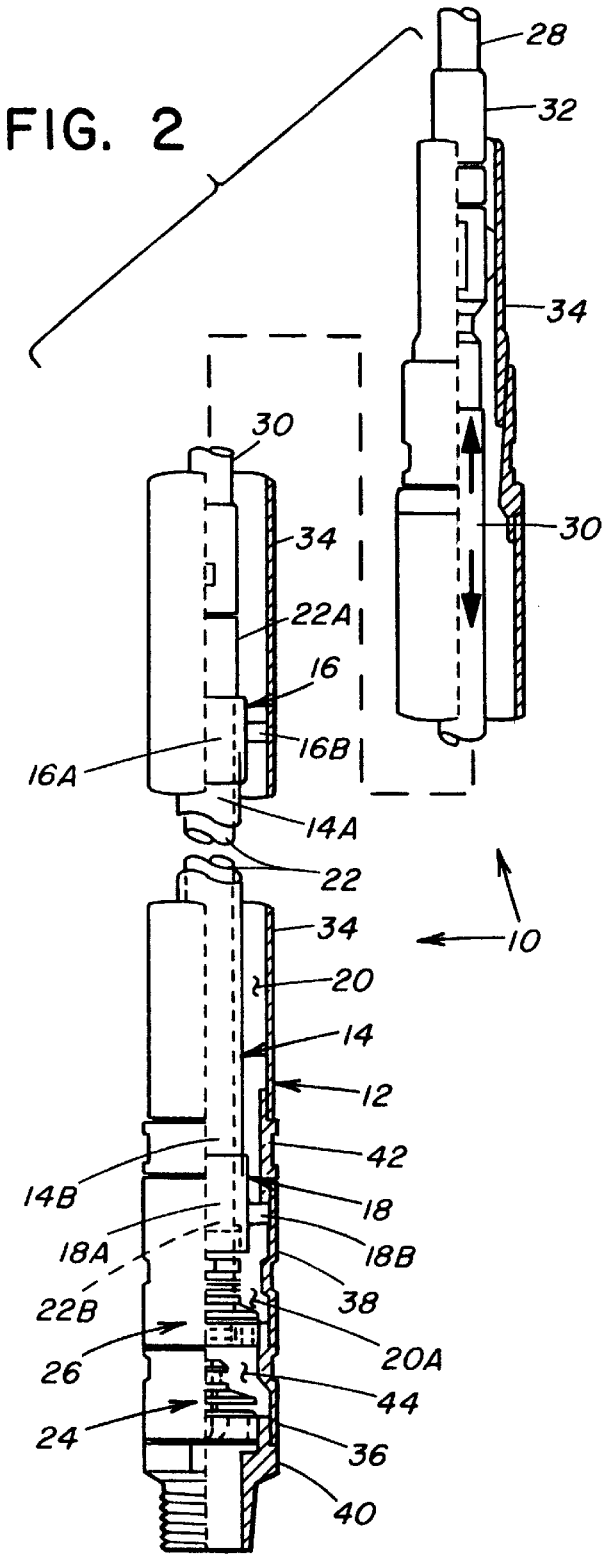
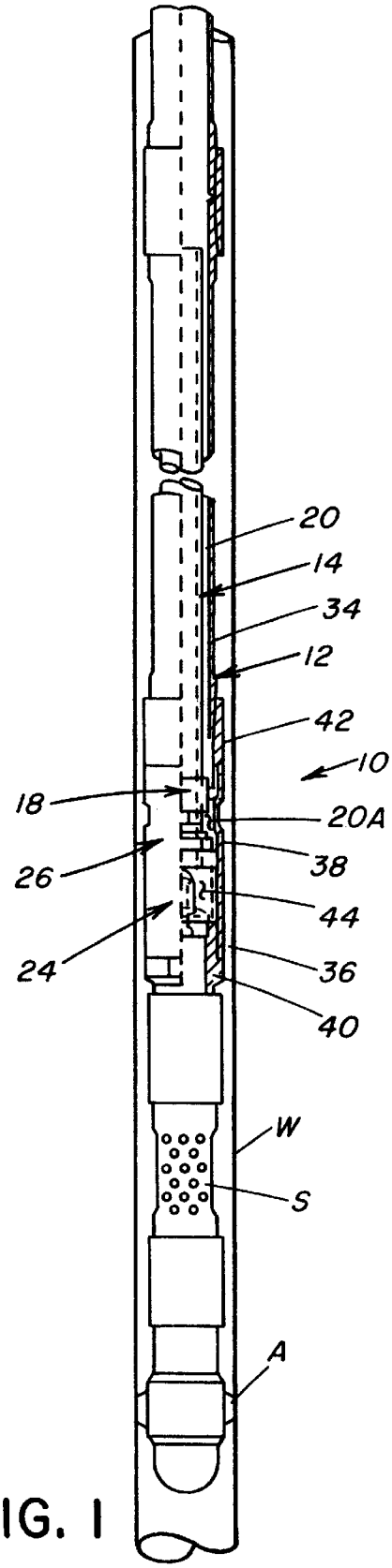
FIG. 1

FULL FLOW TUBING STATIONARY VALVE PUMP APPARATUS

This application claims the benefit of U.S. provisional application No. 60/075,159, filed Feb. 19, 1998.

BACKGROUND OF THE INVENTION

1. Field of the Invention

The present invention generally relates to pumps for oil wells and, more particularly, is concerned with a full flow tubing stationary valve pump apparatus.

2. Description of the Prior Art

Low gravity crude oil deposits are scattered throughout North America and other parts of the world. Large deposits can be found particularly in western portions of the United States and Canada. Deposits may be at depths ranging from the ground surface to 2,000 feet therebelow. Most of the deposits are high water drive. Commercial removal of heavy crude oil with very little gas and high water drive from shallow depths can be very expensive and difficult. Recovery of viscous low gravity oil, however, may well represent a large portion of the future energy needs of North America from fossil fuels.

The commercial recovery of viscous low gravity deposits with conventional API pumps in most cases are marginal at best. Many adverse economic, hydraulic and mechanical changes are involved when attempting to pump this type of fluid, such as (1) reduced price per barrel with increased lifting cost; (2) costly water separating at the surface; (3) poor pumping efficiency (less BPD); and (4) severe emulsion created by excessive turbulence and restricted flow through conventional API ball and seat type valving with high emulsion creation equating to high oil/water separation cost at the surface.

A technique to increase pump efficiency and to lower emulsion creation could make the production of low gravity crude commercially attractive. Consequently, a need remains for some means to recover viscous low gravity oil which is cost efficient and easier to accomplish than by current methods of crude oil extraction.

SUMMARY OF THE INVENTION

The present invention provides a full flow tubing stationary valve pump apparatus designed to satisfy the aforementioned need. The full flow tubing stationary valve pump apparatus of the present invention provides increased pump efficiency with less emulsion creation compared to current methods of extraction which allows economical production from low gravity crude oil reserves not possible with current methods of extraction.

Accordingly, the present invention is directed to a full flow tubing stationary valve pump apparatus which comprises: (a) an outer annulus barrel; (b) an inner working barrel; (c) means for supporting the inner working barrel within the outer annulus barrel in radially inwardly spaced relation therefrom so as to define a vertical flow annulus therebetween; (d) an elongated inner plunger disposed within and vertically movable by upstrokes and downstrokes relative to the inner working barrel; (e) a lower intake valve assembly spaced below the inner plunger and disposed within and supported by the outer annulus barrel; and (f) an upper discharge valve assembly disposed below the inner plunger and inner working barrel and within and supported by the outer annulus barrel above the lower intake valve assembly; (g) the outer annular barrel defining a working chamber between the lower intake valve assembly and upper discharge valve assembly into which crude oil can be drawn through the lower intake valve assembly from a production formation therebelow and from which crude oil can be forced through the upper discharge valve assembly into the vertical flow annulus thereabove. The upstroke of the inner plunger causes the lower intake valve assembly to open and draw crude oil upwardly into the working chamber of the outer annular barrel. The downstroke of the inner plunger causes the upper discharge valve assembly to open and force flow of crude oil upwardly from the working chamber of the outer annular barrel.

More particularly, the lower intake valve assembly of the pump apparatus has a stationary seat defining an annular intake passageway, a cover valve movable between a closed position and an opened position relative to the seat, and first biasing means on the cover valve for biasing the cover valve to the closed position. The upper discharge valve assembly of the pump apparatus has a stationary seat defining an annular discharge passageway, a cover valve disposed in flow communication with the vertical flow annulus thereabove and movable between a closed position and an opened position relative to the seat, and second biasing means on the cover valve for biasing the cover valve to the closed position. The working chamber is disposed in communication with a plugged lower end of the inner plunger, the annular discharge passageway of the stationary seat of the upper discharge valve assembly, and the cover valve of the lower intake valve assembly. The upstroke of the inner plunger pulls a vacuum in the working chamber that overcomes the downward biasing force of the first biasing means on the cover valve of the lower intake valve assembly to cause the cover valve of the lower intake valve assembly to be lifted from the closed position to the opened position off the seat of the lower intake valve assembly and draw crude oil upwardly through the annular intake passageway of the seat of the lower intake valve assembly into the working chamber of the outer annular barrel. The ceasing of the upstroke of the inner plunger and filling of the working chamber of the outer annular barrel with crude oil results in the downward biasing force of the first biasing means of the lower intake valve assembly forcing the return of the cover of the lower intake valve assembly to the closed position on the base of the lower intake valve assembly. The downstroke of the inner plunger causes an increase in pressure or compression of oil in the working chamber that overcomes the hydrostatic pressure of a column of oil in the vertical flow annulus above the upper discharge valve assembly and the downward biasing force of the second biasing means on the cover valve of the upper discharge valve assembly to cause the cover valve of the upper intake valve assembly to be lifted from the closed position to the opened position off the seat of the upper intake valve assembly and force flow of crude oil upwardly through the annular discharge passageway of the seat of the upper discharge valve assembly to the vertical flow annulus.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a side elevational view of a full flow tubing stationary valve pump apparatus of the present invention disposed within a well.

FIG. 2 is an enlarged foreshortened side elevational view of the pump apparatus of FIG. 1.

DETAILED DESCRIPTION OF THE INVENTION

Figure 4:
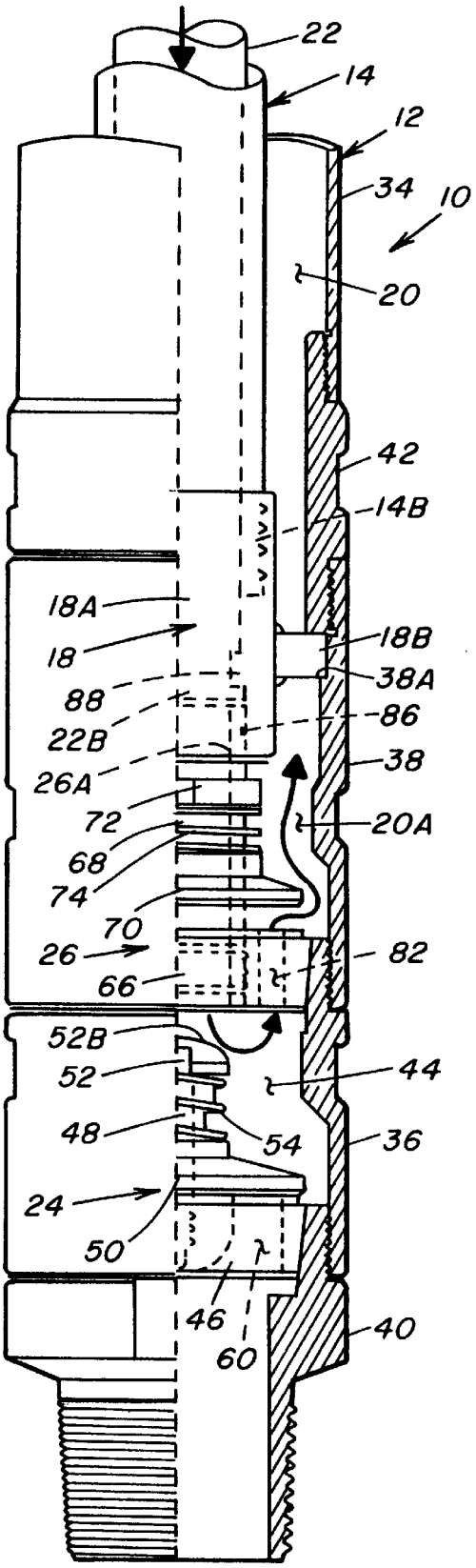
FIG. 4 is an enlarged side elevational view of the pump apparatus similar to that of FIG. 3, but showing the cover valve of the lower intake valve assembly in a closed position and the cover valve of the upper discharge valve assembly of the pump apparatus in the open position.

Referring to the drawings and particularly to FIGS. 1 to 4, there is illustrated a full flow tubing stationary valve pump apparatus, generally designated 10, of the present invention. The full flow tubing stationary valve pump apparatus 1C, for the sake of brevity, is hereafter referred to as the FFT pump apparatus 10.

The FFT pump apparatus 10 basically includes an outer annulus barrel 12, an inner working barrel 14, means for supporting the inner working barrel 14 within the outer annular barrel 12, such as by vertically spaced apart upper and lower centralizers 16, 18, being mounted between the outer annular barrel 12 and the inner working barrel 14 at opposite upper and lower end portions 14A, 14B thereof, so as to position the inner working barrel 14 in a radially inwardly spaced relation to the outer annulus barrel 12 and define a vertical flow annulus 20 therebetween, an elongated inner plunger 22, a lower intake wafer valve assembly 24 and an upper discharge wafer valve assembly 26.

The inner plunger 22 of the pump apparatus 10 is supported below a sinker bar 28 by a pull rod 30 extending between and connected to an upper end 22A of the inner plunger 22 and to a lower end 32 of the sinker bar 28. The sinker bar 28, which extends downward in the well W, is vertically reciprocally driven from above in a manner well known to those of ordinary skill in the art so as to vertically reciprocally move the inner plunger 22, via the pull rod 30, through and along upstrokes and downstrokes relative to the inner working barrel 14.

The lower intake valve assembly 24 is disposed at a lower base region of the FFT pump apparatus 10 within and supported by the outer annulus barrel 12. The upper discharge valve assembly 26 is disposed within and supported by the outer annulus barrel 12 at a location spaced above the lower intake valve assembly 24 and directly below and adjacent to the lower end portion 14B of the inner working barrel 14 such that a plugged lower end 22B of the inner plunger 22 is positioned in pressure and flow communication via a central passageway 26A through the upper discharge valve assembly 26 with the lower intake valve assembly 24 and the upper discharge valve assembly 26 during operation of the FFT pump apparatus 10 in pumping crude oil upward through the vertical flow annulus 20 and therefrom to the well surface. The plugged lower end 22B of the plunger 22 prevents passage of crude oil via the central passageway 26A of the upper discharge valve assembly 26 into the hollow interior of the inner plunger 22. The inner plunger 22 may take the form of a conventional API plunger but without a traveling valve at the lower end 22B.

The outer annulus barrel 12 has an elongated main cylindrical portion 34 and, at the lower base region of the FFT pump apparatus 10, a lower annular intake housing portion 36 and an upper annular discharge housing portion 38. The lower annular intake housing portion 36 surrounds and is radially spaced outwardly from the lower intake valve assembly 24 while the upper annular discharge housing portion 38 surrounds and is radially spaced outwardly from the upper discharge valve assembly 26 and is disposed in tandem relationship with and threadably secured to the lower annular intake housing portion 36. The lower annular intake housing portion 36 is also threadably secured to a lower annular coupler 40 which, in turn, threadably connects with a perforated sub S which extends to a tubing anchor A both of which are disposed in the well W below the FFT pump apparatus 10. The upper annular discharge housing portion 38 is also threadably secured to an upper annular coupler 42 which, in turn, threadably connects to the main cylindrical portion 34 of the outer annulus barrel 12. The lower annular intake housing portion 36 of the outer annulus barrel 12 surrounds an outlet side of the lower intake valve assembly 24 and an inlet side of the upper discharge valve assembly 26 and therewith encloses a space or chamber 44 between the lower intake valve assembly 24 and the upper discharge valve assembly 26 into which crude oil can be drawn by the FFT pump apparatus 10 through the lower intake valve assembly 24 from a production formation via the lower perforated sub S. The upper annular discharge housing portion 38 of the outer annulus barrel 12 surrounds an outlet side of the upper discharge valve assembly 26 and therewith encloses an inlet region 20A to the vertical flow annulus 20 defined between the inner working barrel 14 and the main cylindrical portion 34 of the outer annulus barrel 12 into which crude oil can be pumped from the chamber 44 through the upper discharge valve assembly 26 to the vertical flow annulus 20.

The inner working barrel 14 has a diameter that is less than the diameter of the outer annulus barrel 12 and slightly greater than the diameter of the inner plunger 16. The length of the inner working barrel 14 is less than the length of the inner plunger 16. The upper and lower centralizers 16, 18 support the inner working barrel 14 at the upper and lower end portions 14A, 14B. Each centralizer 16, 18 includes a cylindrical main body 16A, 18A and a plurality of radial extensions 16B, 18B which are circumferentially spaced from one another and fixed to and extend radially outwardly from the main body 16A, 18A. The radial extensions 16B of the upper centralizer 16 extend across the vertical flow annulus 20 into engagement with the main cylindrical portion 34 of the outer annulus barrel 12 while the radial extensions 18B of the lower centralizer 18 extend across the vertical flow annulus 20 into engagement with the upper discharge housing portion 38 of the outer annulus barrel 12. The radial extensions 16B, 18B provide open channels therebetween for the unimpeded passage of crude oil through the vertical flow annulus 20. The main bodies 16A, 18A of the upper and lower centralizers 16, 18 are hollow and threadably secured over the threaded upper and lower end portions 14A, 14B of the inner working barrel 14. The main body 18A of the lower centralizer 18 together with the upper discharge housing portion 38 of the outer barrel 12 supports the upper discharge valve assembly 26. Outer ends of the radial extensions 18B of the lower centralizer 18 are captured between a lower end of the upper annular coupler 42 and an internal shoulder 38A on the upper discharge housing portion 38 of the outer annulus barrel 12 so as to retain and hold the lower end portion 14B of the inner working barrel 14 at a desired position in the outer annulus barrel 12.

Referring now to FIGS. 1 to 7, the lower intake valve assembly 24 includes a seat 46, a valve guide or bushing 48, a cover valve 50, a fastener 52 and biasing means in the form of a compressible and extensible coil spring 54. The seat 46 has a central internally threaded portion 46A. The bushing 48 has a lower end 48A and an upper end 48B. The cover valve 50 is slidably mounted over the lower end 48A of the bushing 48 and is movable toward and away from the seat 46 between a closed position and an opened position relative thereto, as shown respectively in FIGS. 4 and 3. The fastener 52 is inserted through the bushing 48 and has a lower externally threaded end 52A threaded into the central internally threaded portion 46A of the seat 46 and an upper head 52B which constitutes a stop that abuts against the upper end 48B of the bushing 48. The coil spring 54 is mounted over the outside of the bushing 48 and is captured between the cover valve 50 and the upper head 52B of the fastener 52. The seat 46 also has a continuous outer side wall 56 and a continuous inner wall 58 defining the central internally threaded portion 46A of the seat 46 being spaced inwardly from the outer side wall 56. The outer side wall 56 and inner wall 58 together define an annular intake passageway 60 therebetween for the passage of crude oil from the perforated sub S at the inlet side of the lower intake valve assembly 24 upwardly to the chamber 44 between the valve assemblies 24, 26. The seat 46 further has a plurality of interior spaced apart radial legs 62 fixedly connecting the outer side wall 56 and the inner wall 58. The radial legs 62 cross the annular intake passageway 60 of the seat 46 and provide channels 64 therebetween which permit unimpeded flow of the crude oil through the annular intake passageway 60 of the lower intake valve assembly 30. The seat 46 is stationarily supported at an upper end of the lower annular coupler 40 and at a lower end of the lower intake housing portion 36 of the outer annulus barrel 12. The seat 46 and cover valve 50 provide a metal-to-metal seal when the lower intake valve assembly 30 is in the closed condition, with a pair of outer and inner O-rings 47, 49 secured in dovetail grooves defined in top surfaces of the outer side wall 56 and inner wall 58 providing backup seals outside and inside of the upper end of the annular intake passageway 60. The coil spring 54 provides for rapid closing action of the cover valve 50.

Referring now to FIGS. 1 to 4 and 8 to 11, the upper discharge valve assembly 26 includes a seat 66, a tubular valve guide or sleeve 68, a cover valve 70, a stop ring 72 and biasing means in the form of a compressible and extensible coil spring 74. The tubular sleeve 68 has a lower end 68A and an upper end 68B. The cover valve 70 is slidably mounted over the lower end 68A of the sleeve 68 and is movable toward and away from the seat 66 between a closed position and an opened position relative thereto, as shown respectively in FIGS. 3 and 4. The stop ring 72 is mounted to and about the outside of the sleeve 68 adjacent to the upper end 68B. The coil spring 74 is mounted over the outside of the sleeve 68 and is captured between the cover valve 70 and the stop ring 72. The seat 66 has a continuous outer side wall 76, a continuous annular inner wall 78 spaced inwardly from the outer side wall 76 and a plurality of spaced apart radial legs 80 extending between and fixedly interconnecting the outer side wall 76 and the inner wall 78. The seat 66 defines an annular discharge passageway 82 between the outer side wall 76 and the inner wall 78. The radial legs 80 cross the annular discharge passageway 82 and provide channels 84 therebetween which permit unimpeded flow of the crude oil through the annular discharge passageway 82 of the upper discharge valve assembly 32. The seat 66 is stationarily supported at an upper end of the lower intake housing portion 36 and at a lower end of the upper discharge housing portion 38 of the outer annulus barrel 12. The seat 66 and cover valve 70 provide a metal-to-metal seal when the upper discharge valve assembly 32 is in the closed condition, with a pair of outer and inner O-rings 67, 69 secured in dovetail grooves defined in top surfaces of the outer side wall 76 and inner wall 78 providing backup seals outside and inside of the upper end of the annular discharge passageway 82. The coil spring 74 provides for rapid closing action of the cover valve 70.

The upper end 68B of the sleeve 68 is inserted into the inside of the main body 18A of the lower centralizer 18 from a lower end of the main body 18A. The upper end 68B of the sleeve 68 has an annular or O-ring sealing member 86 about the sleeve 68 which engages the inside of the main body 18A of the lower centralizer 18 so as to provide a seal such that crude oil cannot flow upwardly between the sleeve 68 and the inside of the main body 18A of the lower centralizer 18. The sleeve 68 is hollow so as to define the central passageway 26A of the upper discharge valve assembly 26 and thereby provide pressure and flow communication through the upper discharge valve assembly 26 between the plugged lower end 22B of the inner plunger 22 and the chamber 44 between the valve assemblies 24, 26. The lower end 68A of the sleeve 68 is externally threaded so as to threadably fit into an internally threaded central bore 66A through the seat 66 defined by the annular inner wall 78. The inner plunger 22 also has an annular seal 88 provided about the lower end 22B of the plunger 22 which prevents passage of crude oil upwardly between the inner plunger 22 and the inner working barrel 14.

Figure 3:
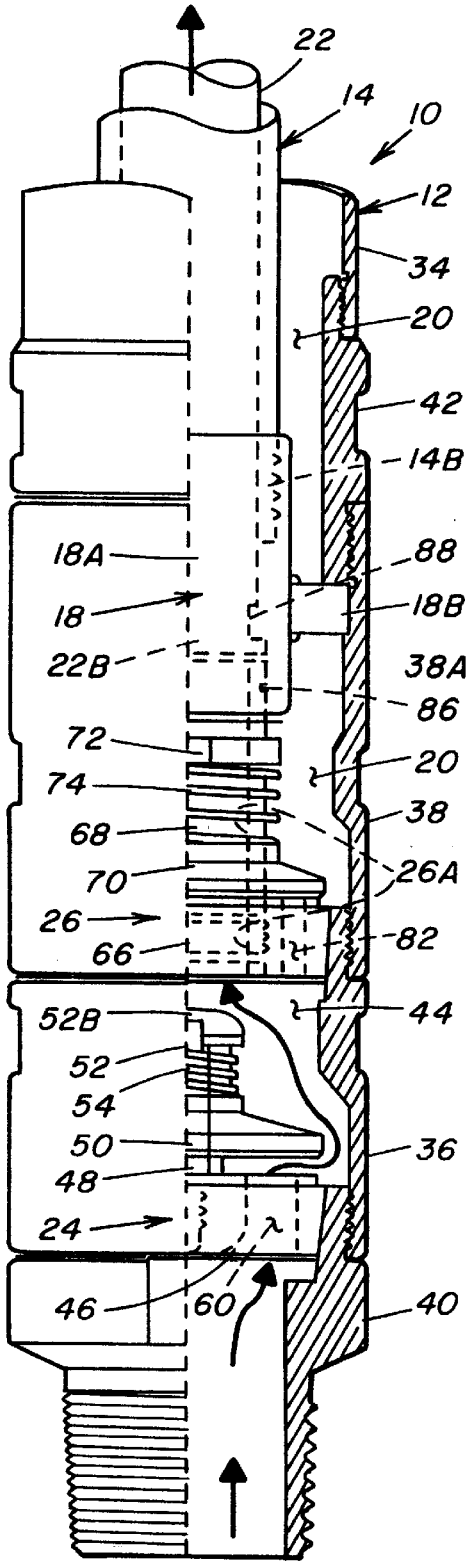
FIG. 3 is an enlarged fragmentary side elevational view of the pump apparatus of FIG. 2, showing a lower intake valve assembly of the pump apparatus having a cover valve in an open position and an upper discharge valve assembly of the pump apparatus having a cover valve in a closed position.
Figure 6:
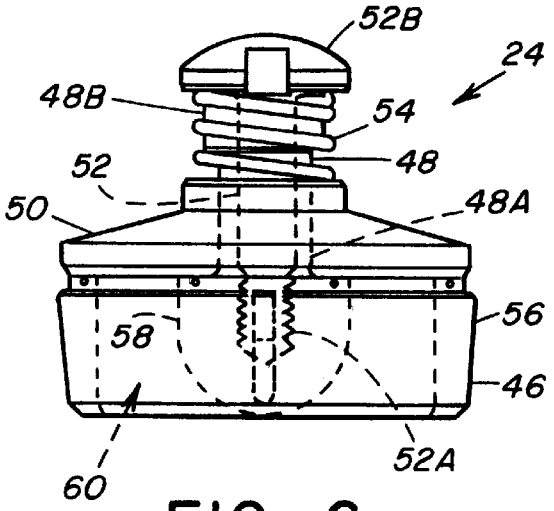
FIG. 6 is an assembled side elevational view of the lower intake valve assembly of the pump apparatus of FIG. 5.
Figure 5:
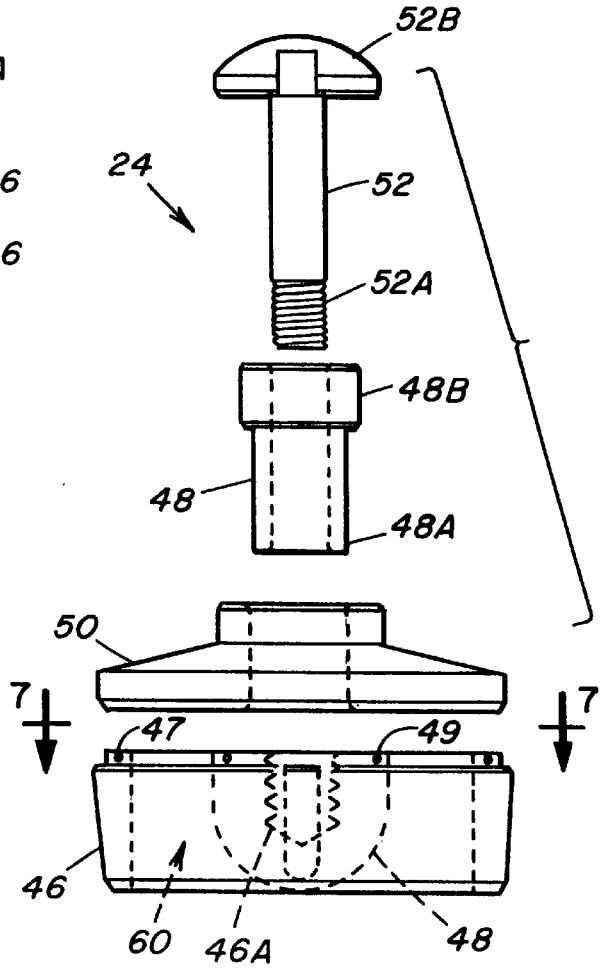
FIG. 5 is an enlarged exploded view of the lower intake valve assembly of the pump apparatus of FIGS. 3 and 4.
Figure 7:
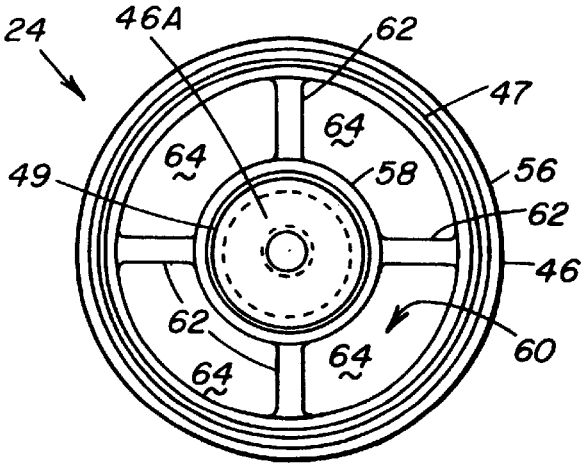
FIG. 7 is a top plan view of a seat of the lower intake valve assembly of the pump apparatus as seen along line 7—7 of FIG. 5.
Figure 9:
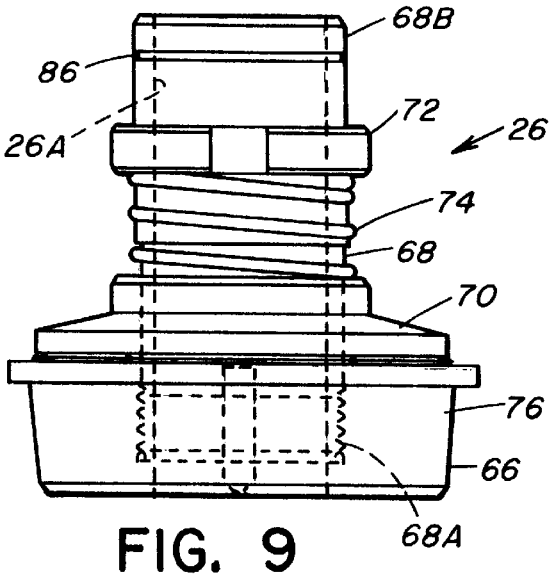
FIG. 9 is an assembled side elevational view of the upper discharge valve assembly of the pump apparatus of FIG. 8.
Figure 8:
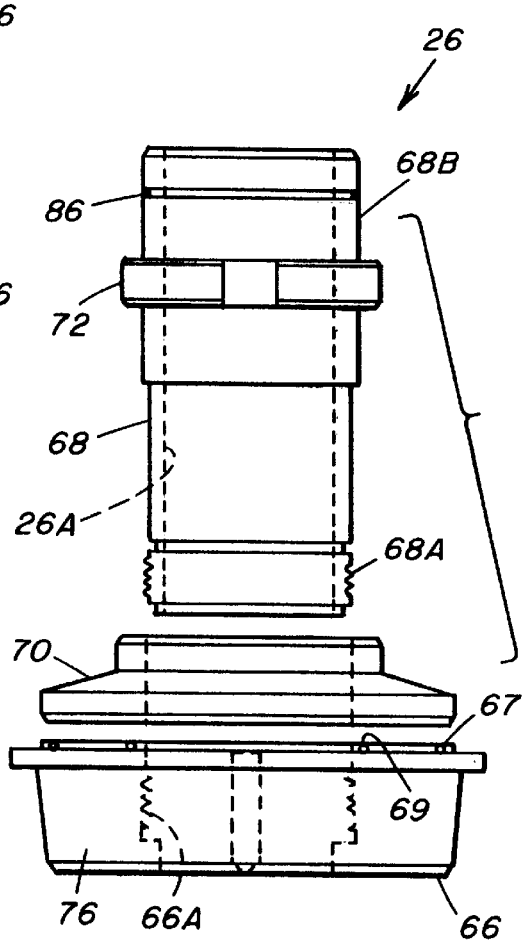
FIG. 8 is an enlarged exploded view of the upper discharge valve assembly of the pump apparatus of FIGS. 3 and 4.
Figure 10:
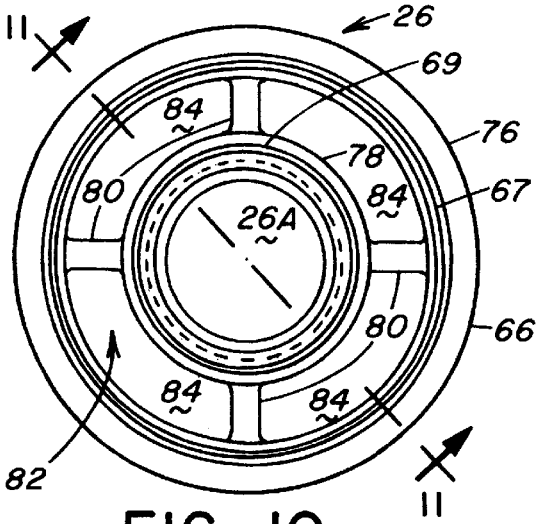
FIG. 10 is a top plan view of a seat of the upper discharge valve assembly of the pump apparatus as seen along line 10—10 of FIG. 8.
Figure 11:
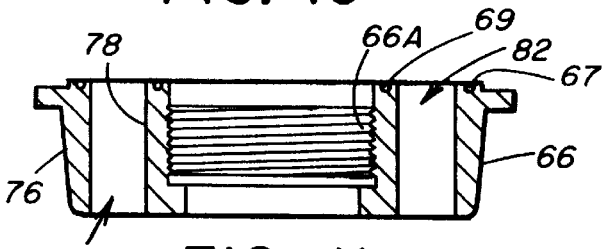
FIG. 11 is a transverse sectional view of the seat of the upper discharge valve assembly of the pump apparatus taken along line 11—11 of FIG. 10.

In operation of the FFT pump assembly 10, the drive means reciprocally moves the inner plunger 22 in repetitive cycles each involving an upstroke and a downstroke. The chamber 44 plus the volume of the central passageway 26A through the upper discharge valve assembly 26 and the volume of the inner working barrel 14 below the plugged end 22B of the inner plunger 22 form a working chamber which has a variable volume. The upstroke of the inner plunger 22 increases the volume of such working chamber and thereby creates a vacuum condition therein which overcomes the downward biasing force of the coil spring 54 on the cover valve 50 of the lower intake valve assembly 24 and causes the cover valve 50 to be lifted off the seat 46, as shown in FIG. 3, and sucks or draws crude oil upwardly through the annular intake passageway 60 of the seat 46 into the working chamber. The hydrostatic pressure of the column of oil in the vertical flow annulus 20 above the upper discharge valve assembly 26 and the biasing force of the coil spring 74 on the cover valve 70 of the upper discharge valve assembly 26 maintain the cover valve 70 in the closed position on the seat 66 of the upper discharge valve 26, as also shown in FIG. 3. During the upstroke of the inner plunger 22 no crude oil is allowed to pass through the annular discharge passageway 82 of the seat 66 of the upper discharge valve assembly 26 into the vertical flow annulus 20 between the barrels 12, 14. When the upstroke of the inner plunger 22 ceases and the working chamber is filled with crude oil, the vacuum condition is no longer being created therein so that the downward biasing force of the coil spring 54 now forces the return of the cover valve 50 to the closed position on the seat 46 of the lower intake valve assembly 24, as shown in FIG. 4. The downstroke of the inner plunger 22 decreases the volume of the working chamber between the valve assemblies 24, 26 and below the plunger end 22B and compresses the crude oil therein producing a force which overcomes the hydrostatic pressure of the column of oil in the vertical flow annulus 20 above the upper discharge valve assembly 26 and the downward biasing force of the coil spring 74 of the upper discharge valve assembly 26 and causes the lifting of the cover valve 70 from the seat 66 from the closed position of FIG. 3 to the opened position of FIG. 4 which forces flow of crude oil upwardly through the annular discharge passageway 82 of the seat 66 into the vertical flow annulus 20 between the barrels 12, 14. The compression of the crude oil caused by the downstroke of the inner plunger 22 maintains the cover valve 50 of the lower intake valve assembly 24 in the closed position on the seat 46, as shown in FIG. 4, preventing any reverse passage of crude oil from the working chamber through the annular intake passageway 60 of the seat 46 of the lower intake valve assembly 24.

Large bore plungers with a short stroke may be used. This would require less upstroke torque and increase "bottom up" time. The cooling effect of the viscous low gravity crude oil would be minimized. By reducing flow restrictions, emulsion would be less. This will reduce the requirement for an oil/water separation process at the surface. Gas lock and liquid pound will virtually be eliminated as there is no traveling valve in the inner plunger 22 and intake and discharge valve assemblies 24, 26 are spaced only about 2½ inches apart at the base region of the FFT pump apparatus 10. The "stroke out" feature will greatly decrease the changes of "plunger sticking" and sanding up.

The percentage of flow area (in inches squared) through the intake and discharge valve assemblies 24, 26 over a 1¼ inch API insert valve ranges from two thousand two hundred eighty percent (2280%) for the FFT pump intake valve assembly 24 to three hundred twenty one percent (321%) over a 2¾ inch API insert valve. The flow area (in inches squared) of discharge increases through API plunger ranges from one thousand eight hundred twenty percent (1820%) over a 1¼ inch plunger to one hundred forty-three percent (143%) over the API 2¾ inch plunger.

The goal of the design of the FFT pump apparatus 10 is to allow a means to commercially produce and deplete low gravity crude oil reserves. A strong possibility exists that conventional API artificial lift pumps can be modified to adopt this new design. Many advantages are accomplished if one can simply modify existing API style pumps and use existing tubular and lifting equipment. Better pump efficiency, less emulsion (from reduced turbulent flows) along with reducing maximum and minimum peak torque requirements could result in a substantial increase in produced barrels of oil per day. The advantage would be two fold, more daily production with less lifting cost.

To summarize, the advantages of the FFT pump apparatus 10 are as follows: (1) a dramatic increase in pump efficiency; (2) higher production rates; (3) lower peak torque requirements; (4) minimum downstroke rod compression; (5) the plunger being longer than the inner barrel reduces plunger "sticking"; (6) elimination of gas lock, closer valve spacing and elimination of a traveling valve; (7) fast valve closure from spring-loaded valves; (8) minimum emulsion; (9) minimum pressure drop through valves; (10) minimum pressure drop on stroke discharge; (11) rugged valve design with a wide range of material (abrasive/corrosion); (12) much longer pump life; (13) same valves for all pump sizes (a wide range of volume requirements); (14) allows for shorter pump strokes and reduces torque; (15) pump assembly simplicity; and (16) can be used on deviated or horizontal wells.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A full flow tubing stationary valve pump apparatus, comprising:

(a) an outer annulus barrel;

(b) an inner working barrel;

(c) means for supporting said inner working barrel within said outer annulus barrel in radially inwardly spaced relation from said outer annular barrel so as to define a vertical flow annulus therebetween;

(d) an elongated inner plunger disposed within and vertically movable by upstrokes and downstrokes relative to said inner working barrel;

(e) a lower intake valve assembly spaced below said inner plunger and disposed within and supported by said outer annulus barrel; and (f) an upper discharge valve assembly disposed below said inner plunger and said inner working barrel and disposed within and supported by said outer annulus barrel above said lower intake valve assembly;

(g) said outer annular barrel defining a working chamber between said lower intake valve assembly and said upper discharge valve assembly into which crude oil can be drawn through said lower intake valve assembly from a production formation therebelow and from which crude oil can be forced through said upper discharge valve assembly into said vertical flow annulus; thereabove;

(h) said upstroke of said inner plunger causing said lower intake valve assembly to open and draw crude oil upwardly into said working chamber of said outer annular barrel; and (i) said downstroke of said inner plunger causing said upper discharge valve assembly to open and force flow of crude oil upwardly from said working chamber of said outer annular barrel.

2. The apparatus of claim 1 wherein said supporting means includes vertically spaced apart upper and lower centralizers mounted about said inner working barrel at upper and lower end portions of said inner working barrel so as to position said inner working barrel in said radially inwardly spaced relation from said outer annulus barrel and define said vertical flow annulus therebetween.

3. The apparatus of claim 1 wherein said inner plunger has a lower end, said lower end of said inner plunger being plugged.

4. The apparatus of claim 1 wherein said inner plunger has a lower end, said lower end of said inner plunger being positioned in pressure and flow communication with said upper discharge valve assembly and said lower intake valve assembly during operation of said inner plunger in pumping crude oil upward.

5. The apparatus of claim 1 wherein:

said working chamber of said outer annular barrel has a variable volume;

said upstroke of said inner plunger increases said volume of said working chamber of said outer annular barrel and thereby creates a vacuum condition therein, ceasing of said upstroke of said inner plunger and filling of said working chamber of said outer annular barrel with crude oil causes the vacuum condition to cease; and said downstroke of said inner plunger decreases said volume of said working chamber of said outer annular barrel and thereby compresses the crude oil therein.

6. The apparatus of claim 1 wherein said lower intake valve has a stationary seat defining an annular intake passageway, a cover valve movable between a closed position and an open position relative to said annular intake passageway of said seat, and spring means on said cover valve exerting a downward biasing force on said cover valve to move said cover valve to said closed position.

7. The apparatus of claim 6 wherein said upstroke of said inner plunger overcomes said downward biasing force of said spring means on said cover valve of said lower intake valve assembly and causes said cover valve of said lower intake valve assembly to be lifted from said closed position to said open position off said seat of said lower intake valve assembly and draws crude oil upwardly through said annular intake passageway of said seat of said lower intake valve assembly.

8. The apparatus of claim 7 wherein ceasing of said upstroke of said inner plunger and filling of said working chamber of said outer annular barrel with crude oil results in said downward biasing force of said spring means of said lower intake valve assembly forcing the return of said cover valve of said lower intake valve assembly to said closed position on said seat of said lower intake valve assembly.

9. The apparatus of claim 1 wherein said upper discharge valve assembly has a stationary seat defining an annular discharge passageway, a cover valve movable between a closed position and an open position relative to said annular discharge passageway of said seat, and spring means on said cover valve exerting a downward biasing force on said cover valve to move said cover valve to said closed position.

10. The assembly of claim 9 wherein said downstroke of said inner plunger overcomes hydrostatic pressure of a column of oil in said vertical flow annulus above said upper discharge valve assembly and said downward biasing force of said spring means on said cover valve of said upper discharge valve assembly and causes said cover valve of said upper discharge valve assembly to be lifted from said closed position to said open position off said seat of said upper discharge valve assembly and forces flow of crude oil upwardly through said annular discharge passageway of said seat of said upper discharge valve assembly.

11. A full flow tubing stationary valve pump apparatus, comprising:

(a) an outer annulus barrel;

(b) an inner working barrel having upper and lower end portions;

(c) means for supporting said inner working barrel within said outer annulus barrel in radially inwardly spaced relation from said outer annular barrel so as to define a vertical flow annulus therebetween;

(d) an elongated inner plunger disposed within and vertically movable by upstrokes and downstrokes relative to said inner working barrel;

(e) a lower intake valve assembly disposed within and supported by said outer annulus barrel; and (f) an upper discharge valve assembly disposed within and supported by said outer annulus barrel at a location spaced above said lower intake valve assembly;

(g) said outer annular barrel defining a working chamber having a variable volume and disposed between said lower intake valve assembly and said upper discharge valve assembly into which crude oil can be drawn through said lower intake valve assembly from a production formation therebelow and from which crude oil can be forced through said upper discharge valve assembly into said vertical flow annulus thereabove;

(h) said upstroke of said inner plunger increasing said volume of said working chamber of said outer annular barrel and thereby creating a vacuum condition therein and causing said lower intake valve assembly to open and draw crude oil upwardly into said working chamber of said outer annular barrel, ceasing of said upstroke of said inner plunger and filling of said working chamber of said outer annular barrel with crude oil causing the vacuum condition to cease;

(i) said downstroke of said inner plunger decreasing said volume of said working chamber of said outer annular barrel and thereby compressing the crude oil therein and causing said upper discharge valve assembly to open and forcing flow of crude oil upwardly from said working chamber of said outer annular barrel into said vertical flow annulus.

12. The apparatus of claim 11 wherein said supporting means includes vertically spaced apart upper and lower centralizers mounted about said inner working barrel at said upper and lower end portions of said inner working barrel so as to position said inner working barrel in said radially inwardly spaced relation from said outer annulus barrel and define said vertical flow annulus therebetween.

13. The apparatus of claim 11 wherein said lower intake valve assembly is spaced below said inner plunger.

14. The apparatus of claim 11 wherein said upper intake valve assembly is disposed below said inner plunger and said lower end portion of said inner working barrel.

15. The apparatus of claim 11 wherein said inner plunger has a lower end, said lower end of said inner plunger being plugged.

16. The apparatus of claim 11 wherein said inner plunger has a lower end, said lower end of said inner plunger being positioned in pressure and flow communication with said upper discharge valve assembly and lower intake valve assembly.

17. The apparatus of claim 11 wherein said lower intake valve assembly has a stationary seat defining an annular intake passageway, a cover valve movable between a closed position and an open position relative to said annular intake passageway of said seat, and spring means on said cover valve exerting a downward biasing force on said cover valve to move said cover valve to said closed position.

18. The apparatus of claim 17 wherein said upstroke of said inner plunger overcomes said downward biasing force of said spring means on said cover valve of said lower intake valve assembly and causes said cover valve of said lower intake valve assembly to be lifted from said closed position to said open position off said seat of said lower intake valve assembly and draws crude oil upwardly through said annular intake passageway of said seat of said lower intake valve assembly.

19. The apparatus of claim 18 wherein said ceasing of said upstroke of said inner plunger and filling of said working chamber of said outer annular barrel with crude oil results in said downward biasing force of said spring means of said lower intake valve assembly forcing the return of said cover valve of said lower intake valve assembly to said closed position on said seat of said lower intake valve assembly.

20. The apparatus of claim 11 wherein said upper discharge valve assembly has a stationary seat defining an annular discharge passageway, a cover valve movable between a closed position and an open position relative to said annular discharge passageway of said seat, and spring means on said cover valve exerting a downward biasing force on said cover valve to move said cover valve to said closed position.

21. The apparatus of claim 20 wherein said downstroke of said inner plunger overcomes hydrostatic pressure of a column of oil in said vertical flow annulus above said upper discharge valve assembly and said downward biasing force of said spring means on said cover valve of said upper discharge valve assembly and causes said cover valve of said upper discharge valve assembly to be lifted from said closed position to said open position off said seat of said upper discharge valve assembly and forces flow of crude oil upwardly through said annular discharge passageway of said seat of said upper discharge valve assembly.

22. A full flow tubing stationary valve pump apparatus, comprising:

(a) an outer annulus barrel;

(b) an inner working barrel having upper and lower end portions;

(c) means for supporting said inner working barrel within said outer annulus barrel and radially inwardly spaced therefrom to define a vertical flow annulus therebetween;

(d) an elongated inner plunger disposed within and vertically movable by upstrokes and downstrokes relative to said inner working barrel;

(e) a lower intake valve assembly disposed within and supported by said outer annulus barrel, said lower intake valve assembly including (i) a stationary seat defining an annular intake passageway, (ii) a cover valve movable between a closed position and an opened position relative to said seat, and (iii) first biasing means on said cover valve for biasing said cover valve to said closed position; and (f) an upper discharge valve assembly disposed within and supported by said outer annulus barrel at a location spaced above said lower intake valve assembly, said upper discharge valve assembly including (i) a stationary seat defining an annular discharge passageway, (ii) a cover valve disposed in communication with said vertical flow annulus thereabove and movable between a closed position and an opened position relative to said seat, and (iii) second biasing means on said cover valve for biasing said cover valve to said closed position;

(g) said outer annular barrel defining a working chamber between said lower intake valve assembly and said upper discharge valve assembly into which crude oil can be drawn through said annular intake passageway of said seat of said lower intake valve assembly from a production formation therebelow upon movement of said cover valve of said lower intake valve assembly to said opened position, said working chamber being in communication with a lower end of said inner plunger, said annular discharge passageway of said seat of said upper discharge valve assembly and said cover valve of said lower intake valve assembly;

(h) said upstroke of said inner plunger pulling a vacuum in said working chamber that overcomes said downward biasing force of said first biasing means on said cover valve of said lower intake valve assembly to cause said cover valve of said lower intake valve assembly to be lifted from said closed position to said opened position off said seat of said lower intake valve assembly and draw crude oil upwardly through said annular intake passageway of said seat of said lower intake valve assembly and into said working chamber of said outer annular barrel;

(i) ceasing of said upstroke of said inner plunger and filling of said working chamber of said outer annular barrel with crude oil resulting in said downward biasing force of said first biasing means of said lower intake valve assembly forcing the return of said cover valve of said lower intake valve assembly to said closed position on said seat of said lower intake valve assembly;

(j) said downstroke of said inner plunger causing an increase in pressure in said working chamber that overcomes hydrostatic pressure of a column of oil in said vertical flow annulus above said upper discharge valve assembly and said downward biasing force of said second biasing means on said cover valve of said upper discharge valve assembly to cause said cover valve of said upper intake valve assembly to be lifted from said closed position to said open position off said seat of said upper intake valve assembly and force flow of crude oil upwardly through said annular discharge passageway of said seat of said upper discharge valve assembly to said vertical flow annulus.

23. The apparatus of claim 22 wherein said supporting means includes vertically spaced apart upper and lower centralizers mounted about said inner working barrel at said upper and lower end portions of said inner working barrel so as to position said inner working barrel in said radially inwardly spaced relation from said outer annulus barrel and define said vertical flow annulus therebetween.

24. The apparatus of claim 22 wherein said lower intake valve assembly is spaced below said inner plunger.

25. The apparatus of claim 22 wherein said upper intake valve assembly is disposed below said inner plunger and said lower end portion of said inner working barrel.

26. The apparatus of claim 22 wherein said lower end of said inner plunger is plugged.

27. The apparatus of claim 22 wherein said lower end of said inner plunger is positioned in pressure and flow communication with said upper discharge valve assembly and said lower intake valve assembly.

28. The apparatus of claim 22 wherein:

said working chamber of said outer annular barrel has a variable volume;

said upstroke of said inner plunger increases said volume of said working chamber of said outer annular barrel and thereby creates a vacuum condition therein;

said ceasing of said upstroke of said inner plunger and filling of said working chamber of said outer annular barrel with crude oil causes the vacuum condition to cease; and said downstroke of said inner plunger decreases said volume of said working chamber of said outer annular barrel and thereby compresses the crude oil therein.

* * * * *